US007616911B2

(12) United States Patent
Kietzman

(10) Patent No.: US 7,616,911 B2
(45) **Date of Patent: *Nov. 10, 2009**

(54) ELECTROPHOTOGRAPHIC PRINTER AND METHOD OF OPERATION SO AS TO MINIMIZE PRINT DEFECTS

(75) Inventor: John W. Kietzman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 383 days.

This patent is subject to a terminal disclaimer.

(21) Appl. No.: 11/390,400

(22) Filed: Mar. 27, 2006

(65) Prior Publication Data

US 2007/0223951 A1 Sep. 27, 2007

(51) Int. Cl.
*G03G 15/20* (2006.01)

(52) U.S. Cl. ..... 399/68; 399/45

(58) Field of Classification Search ..... 399/45, 399/68, 322, 400, 16, 389; 271/2
See application file for complete search history.

(56) References Cited

U.S. PATENT DOCUMENTS

| | | | | |
|---|---|---|---|---|
| 4,561,756 | A | 12/1985 | Lang | |
| 4,941,021 | A * | 7/1990 | Uchida et al. | 399/322 |
| 5,040,781 | A * | 8/1991 | Matoba | 271/242 |
| 5,043,771 | A | 8/1991 | Shibata et al. | |
| 5,075,732 | A | 12/1991 | Menjo | |
| 5,119,146 | A | 6/1992 | Nobumori et al. | |
| 5,166,735 | A | 11/1992 | Malachowski | |
| 5,493,374 | A | 2/1996 | Smith et al. | |
| 5,678,127 | A * | 10/1997 | Suga | 399/45 |
| 5,745,831 | A | 4/1998 | Nakazawa et al. | |
| 5,745,832 | A | 4/1998 | Yoshiuchi | |
| 5,768,655 | A | 6/1998 | Yoshino et al. | |
| 6,026,276 | A | 2/2000 | Malachowski | |
| 6,088,567 | A | 7/2000 | Miyashiro et al. | |
| 6,345,171 | B1 | 2/2002 | Suga | |
| 6,385,406 | B1 * | 5/2002 | Funamizu et al. | 399/16 |
| 6,577,843 | B2 | 6/2003 | Akita et al. | |
| 6,671,487 | B2 | 12/2003 | Stringham | |
| 6,674,979 | B2 * | 1/2004 | Nagano | 399/68 |
| 6,718,155 | B2 | 4/2004 | Kaji et al. | |
| 6,799,000 | B2 | 9/2004 | Aslam et al. | |
| 6,804,478 | B2 | 10/2004 | Martin et al. | |

(Continued)

FOREIGN PATENT DOCUMENTS

JP 11038820 A * 2/1999

(Continued)

*Primary Examiner*—Robert Beatty

(57) ABSTRACT

A method is provided for operating an electrophotographic printer comprising providing an electrophotographic printer comprising a substrate transport assembly including a substrate transport member and a fuser assembly including a fuser member. The substrate transport assembly is operated such that the substrate transport member is driven at a substrate transport linear speed. The fuser assembly is operated such that an outer surface of the fuser member moves at a fuser assembly linear speed. The fuser assembly linear speed is a first fractional amount of the substrate transport linear speed for at least normal size substrates such that a bubble in a normal size substrate between the paper transport assembly and the fuser assembly is created, and the fuser assembly linear speed is a second fractional amount of the substrate transport linear speed for envelopes. The second fractional amount may be greater than the first fractional amount.

24 Claims, 7 Drawing Sheets

U.S. PATENT DOCUMENTS

| | | | | |
|---|---|---|---|---|
| 6,816,685 | B2 | 11/2004 | Eda | |
| 6,816,686 | B2 | 11/2004 | Hooper et al. | |
| 6,892,038 | B2 * | 5/2005 | Fukutani | 399/68 |
| 6,898,387 | B2 | 5/2005 | Kawamura | |
| 7,054,571 | B2 * | 5/2006 | Camp et al. | 399/68 |
| 7,289,744 | B2 * | 10/2007 | Shirakata et al. | 399/67 |
| 2004/0035843 | A1 | 2/2004 | Hamilton et al. | |
| 2005/0152710 | A1 | 7/2005 | Camp et al. | |
| 2005/0163542 | A1 | 7/2005 | Gilmore et al. | |
| 2005/0214010 | A1 | 9/2005 | Kietzman et al. | |
| 2008/0101813 | A1 * | 5/2008 | Maul et al. | 399/68 |

FOREIGN PATENT DOCUMENTS

| | | | |
|---|---|---|---|
| JP | 2000137421 | A * | 5/2000 |
| JP | 2003345150 | A * | 12/2003 |
| JP | 2005284020 | A * | 10/2005 |

* cited by examiner

ELECTROPHOTOGRAPHIC PRINTER AND METHOD OF OPERATION SO AS TO MINIMIZE PRINT DEFECTS

BACKGROUND OF THE INVENTION

1. Field of the Invention

The present invention relates to electrophotographic (EP) printers, and, more particularly, to such printers capable of and a method for changing fuser member speed and/or substrate transport assembly speed in order to minimize print defects caused by speed mismatches between the fuser member and the substrate transport assembly.

2. Description of the Related Art

Cost and market pressures promote the design of the smallest possible printer with the shortest possible length of substrate path. Short substrate paths mean that most substrates are involved in more than one operation at once. For example, a substrate in a printer may be at one or more imaging stations while it is also located in a fuser assembly.

Tandem color laser printers may use a substrate transport belt to move a substrate past successive imaging stations before fusing the final image onto the substrate. If a substrate is pulled taut between an imaging nip and a nip in the fuser assembly, a disturbance force transmitted via the substrate from the fuser assembly to the imaging nip defined by a photoconductive drum and the substrate transport belt may cause image registration or alignment errors. To prevent such errors, the fuser assembly may be under driven so that a substrate bubble accumulates between the transport belt and the fuser assembly. Since the fuser assembly runs more slowly, a substrate never becomes taut, so less disturbance force can be transmitted from the fuser assembly to the imaging nip. However, the pursuit of small machines means that substrate bubbles must be constrained to stay as small as possible. If a machine is designed for a certain maximum bubble size, large velocity variations can make the substrate form a bigger bubble. If this happens, the substrate may make contact structure within the printer which may scrape across the image area, causing print defects.

There is a need for driving the fuser assembly so that an outer surface speed of a rotating fuser member is less than the speed of the substrate transport assembly upstream from it such that a substrate bubble develops between the fuser assembly and the substrate transport assembly, yet, in the case of long substrates or envelopes, the bubble is not allowed to grow too large as to result in print defects.

SUMMARY OF THE INVENTION

In accordance with a first aspect of the present invention, a method is provided for operating an electrophotographic printer. The method comprises providing an electrophotographic printer comprising a substrate transport assembly including at least one substrate transport member and a fuser assembly including a fuser member, operating the substrate transport assembly such that the at least one substrate transport member is driven at a substrate transport linear speed, and operating the fuser assembly such that an outer surface of the fuser member moves at a fuser assembly linear or surface speed. Preferably, the fuser assembly linear speed is a first fractional amount of the substrate transport linear speed for at least normal size substrates such that a bubble in a normal size substrate between the paper transport assembly and the fuser assembly is created, and the fuser assembly linear speed is a second fractional amount of the substrate transport linear speed for envelopes. Preferably, the second fractional amount is greater than the first fractional amount.

The first fractional amount may be from about 0.988 to about 0.996. The second fractional amount may be from about 0.996 to about 0.9995.

The fuser assembly linear speed may also be a third fractional amount of the substrate transport linear speed for long substrates, wherein the third fractional amount is preferably greater than the first fractional amount. "Long substrates" may comprise substrates longer than an A4 substrate. The third fractional amount may be from about 0.994 to about 0.999.

Preferably, the substrate transport assembly comprises at least one of a belt and a plurality of rolls. It is also preferred that the fuser member comprise one of a roll and a belt.

In accordance with a second aspect of the present invention, an electrophotographic printer is provided comprising a substrate transport assembly including a first drive motor for driving at least one substrate transport member, a fuser assembly comprising a second drive motor for driving at least one fuser member, and control structure for controlling the operation of the first and second drive motors such that the first drive motor drives the at least one substrate transport member at a substrate transport linear speed and the second drive motor drives the fuser member such that an outer surface of the fuser member moves at a fuser assembly linear speed. Preferably, the fuser assembly linear speed is a first fractional amount of the substrate transport linear speed for at least normal size substrates such that a bubble in a normal size substrate between the paper transport assembly and the fuser assembly is created, and the fuser assembly linear speed is a second fractional amount of the substrate transport linear speed for envelopes, wherein the second fractional amount is greater than the first fractional amount.

In accordance with a third aspect of the present invention, a method is provided for operating an electrophotographic printer. The method comprises providing an electrophotographic printer comprising a substrate transport assembly including at least one substrate transport member and a fuser assembly including a fuser member, operating the substrate transport assembly such that the at least one substrate transport member is driven at a substrate transport linear speed, and operating the fuser assembly such that an outer surface of the fuser member moves at a fuser assembly linear speed. Preferably, a first ratio of the fuser assembly linear speed to the substrate transport linear speed is equal to a first value less than 1 for at least normal size substrates such that a bubble in a normal size substrate between the paper transport assembly and the fuser assembly is created, and a second ratio of the fuser assembly linear speed to the substrate transport linear speed is equal to a second value less than 1 for multilayer substrates. Preferably, the second value is greater than the first value.

The first value may be from about 0.988 to about 0.996. The second value may be from about 0.996 to about 0.9995.

A third ratio of the fuser assembly linear speed to the substrate transport linear speed may be equal to a third value less than 1 for long substrates, wherein the third value is preferably greater than the first value. The third value may be from about 0.994 to about 0.999.

In accordance with a fourth aspect of the present invention, a method is provided for operating an electrophotographic printer. The method comprises providing an electrophotographic printer comprising a substrate transport assembly including at least one substrate transport member and a fuser assembly including a fuser member, operating the substrate transport assembly such that the at least one substrate transport member is driven at a substrate transport linear speed, and operating the fuser assembly such that an outer surface of the fuser member moves at a fuser assembly linear speed. Preferably, the fuser assembly linear speed is a first fractional amount of the substrate transport linear speed for at least normal size substrates such that a bubble in a normal size substrate between the paper transport assembly and the fuser assembly is created, and the fuser assembly linear speed is another fractional amount of the substrate transport linear speed for long substrates and the other fractional amount is greater than the first fractional amount.

DETAILED DESCRIPTION OF THE INVENTION

Figure 1:
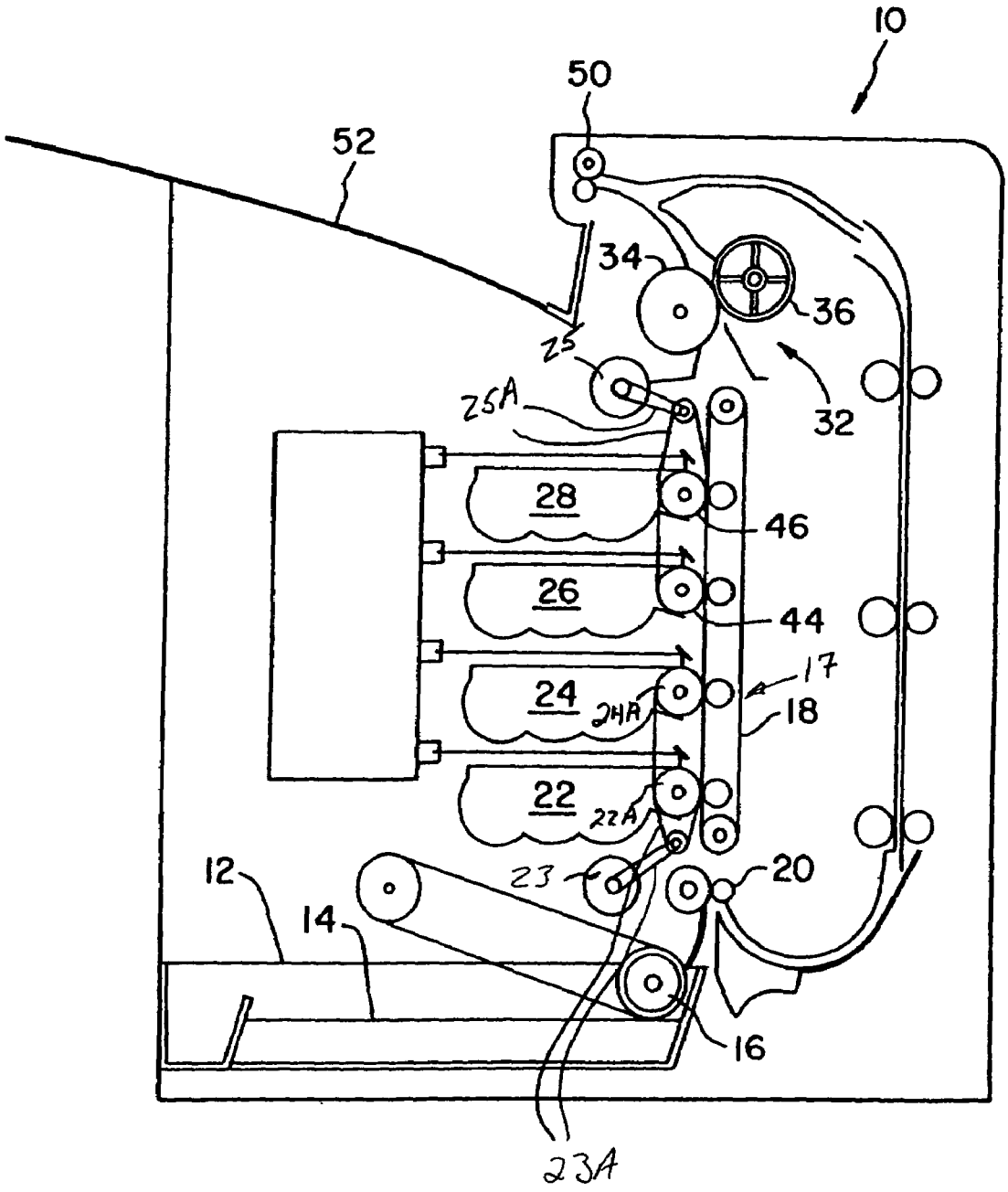
FIG. 1 is a schematic side view of an embodiment of an electrophotographic printer of the present invention.
Figure 2:
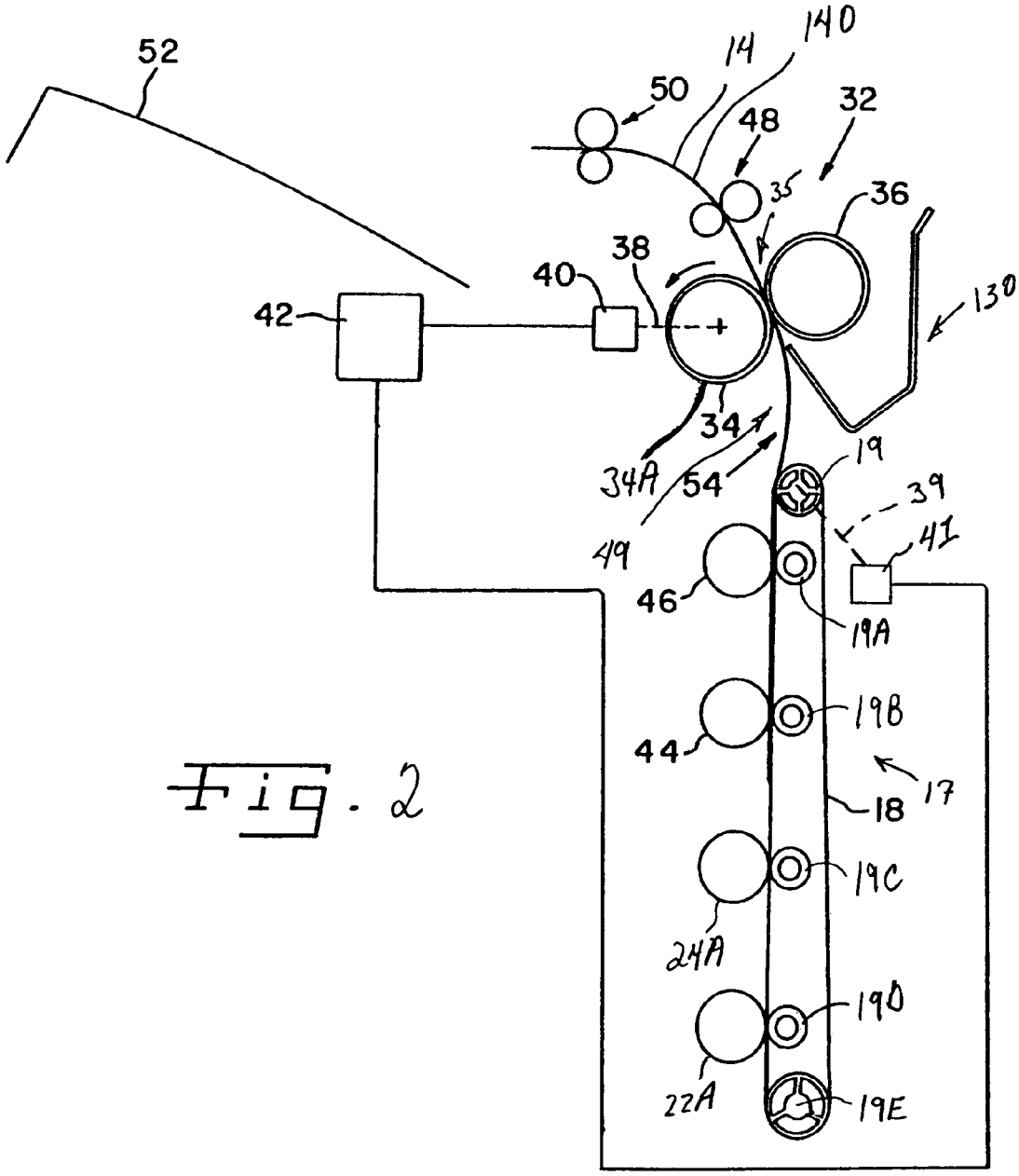
FIG. 2 is a schematic, side view of a paper transport assembly, a fuser assembly, and electrical circuit of the EP printer shown in FIG. 1, wherein an envelope is shown passing through nips defined by two photoconductor drums and a transport belt and rolls of the fuser assembly.

Referring now to the drawings and particularly to FIG. 1, there is shown an embodiment of an EP printer 10 of the present invention. Substrate supply tray 12 contains a plurality of substrates 14, such as paper, transparencies, envelopes or the like. A pick roll 16 is provided for feeding substrates 14 to a substrate transport assembly 17 comprising, in the illustrated embodiment, a substrate transport belt 18, a drive roll 19 and idler rolls 19A-19E, see FIG. 2. The transport belt 18 is also referred to herein as a substrate transport member. In place of the transport belt 18, the substrate transport assembly may comprise one or more transport rolls (not shown). Pick roll 16 picks an individual substrate 14 from within the substrate supply tray 12 and transports the substrate 14 to a nip defined in part by roll 20 to the transport belt 18. The transport belt 18 transports an individual substrate 14 past a plurality of color imaging stations 22, 24, 26 and 28, which apply toner particles of a given color to the substrate 14 at selected pixel locations. The transport belt drive roll 19 is schematically illustrated in FIG. 2 as being connected via phantom line 39 to a drive motor 41, which, in turn, is connected to and controllably operated by an electrical processing circuit 42, such as a microprocessor. The driven transport belt 18 moves at a substrate transport linear speed. The transport belt 18 may be driven at more than one transport linear speed, which speed may vary based on substrate type, substrate size and/or print resolution. In the illustrated embodiment, the drive motor 41 comprises a stepper motor which is controlled by the circuit 42 to operate at one or more desired speeds corresponding to one or more desired speeds of the belt 18. The drive motor 41 is mounted to a frame of the printer and also forms part of the substrate transport assembly 17. In the illustrated embodiment, no sensor is provided in the printer 10 for directly sensing the speed of the belt 18.

In the embodiment shown, color imaging station 22 is a black (K) color imaging station; color imaging station 24 is a magenta (M) color imaging station; color imaging station 26 is a cyan (C) color imaging station; and color imaging station 28 is a yellow (Y) color imaging station. Color imaging station 22 comprises a photoconductive (PC) drum 22A; color imaging station 24 comprises a PC drum 24A; color imaging station 26 comprises a PC drum 44; and color imaging station 28 comprises a PC drum 46. The PC drums 22A and 24A are coupled to and driven by a first PC drum drive motor 23 via conventional coupling structure 23A shown schematically in FIG. 1 as drive belts. The PC drums 44 and 46 are coupled to and driven by a second PC drum drive motor 25 via conventional coupling structure 25A, shown schematically in FIG. 1 as drive belts. The PC drum drive motors 23, 25 are coupled to and controlled via the electrical processing circuit 42. The circuit 42 controls the drive motors 23, 25 such that outer surfaces of the PC drums 22A, 24A, 44 and 46 move at a linear speed which is approximately the same as the substrate transport linear speed. Idler rolls 19A-19D oppose respectively PC drums 46, 44, 24A and 22A, see FIG. 2.

Substrate transport belt 18 transports an individual substrate 14, see FIG. 2, to a fuser assembly 32, where toner particles are fused to the substrate 14 through the application of heat. The fuser assembly 32 includes, in the illustrated embodiment, a hot fuser roll 34, also referred to herein as a "fuser member," and a back up roll 36, which together define a nip 35 for receiving a toned substrate 14. In the embodiment shown, the hot roll 34 is a driven roll and back-up roll 36 is an idler roll; however, the drive scheme may be reversed depending upon the application. Techniques for the general concepts of heating fuser roll 34 are conventional and not described in detail herein. The fuser roll 34 is schematically illustrated as being connected via phantom line 38 to a drive motor 40, which, in turn, is connected to and controllably operated by the electrical processing circuit 42. No sensor is provided in the printer 10 for directly sensing the speed of the driven roll 34 or the back-up roll 36. However, such a sensor could be provided to directly sense the speed of the driven roll 34 and provide driven roll speed feedback to the circuit 42. An encoder or like sensor is provided in the drive motor 40 for sensing the speed of the motor 40 so as to allow the circuit 42 to maintain the motor 40 at a desired or calibrated speed.

In an alternative embodiment, the hot roll 34 may be replaced by a belt fuser, such as disclosed in United States Published Patent Application US 2004/0035843 A1, entitled "Large Area Alumina Ceramic Heater," filed on Aug. 26, 2002 by Hamilton et al., the entire disclosure of which is incorporated herein by reference. In a further alternative embodiment, the backup-roll 36 may be replace by a back-up belt, such as disclosed in United States Published Patent Application US 2005/0163542 A1, entitled "Backup Belt Assembly for Use in a Fusing System and Fusing Systems Therewith," filed on Jan. 28, 2004 by Gilmore et al., the entire disclosure of which is incorporated herein by reference.

In FIG. 2, the substrate 14 is concurrently present at a nip defined by the PC drum 44 of color imaging station 26 and the transport belt 18; a nip defined by the PC drum 46 of color imaging station 28 and the transport belt 18; the nip 35 defined between fuser roll 34 and back-up roll 36; a nip defined by fuser exit rolls 48 and a nip defined by machine output rolls 50. The leading edge of the substrate 14 is received within an output tray 52 on the discharge side of machine output rolls 50.

The substrate 14, after passing through a nip defined by the PC drum 22A and the transport belt 18, is electrostatically tacked to the belt 18.

An outer surface 34A of the driven hot fuser roll 34 moves at a fuser assembly linear speed. The fuser assembly linear speed defines the linear speed of a substrate 14 as it moves through the nip 35 defined by the rolls 34 and 36. It is undesirable to overdrive the fuser roll 34 such that the fuser assembly linear speed exceeds the substrate transport linear speed of the transport belt 18. The force on the substrate 14 from the fuser roll 34 and back-up roll 36 typically is larger than the combination of the forces from the nips at the PC drums 44 and 46 and the transport belt 18 and the electrostatic forces tacking the substrate 14 to the transport belt 18 and, thus, the nip pressure and fuser assembly linear speed at fuser assembly nip 35 tend to dominate over the substrate transport linear speed of the transport belt 18 and the speed of one or more of the PC drums 22A, 24A, 44 and 46. If the fuser roll 34 is overdriven such that the fuser assembly linear speed is greater than the substrate transport linear speed, then print defects may occur on a substrate 14 due, at least in part, to the substrate 14 being pulled through the nips defined by the PC drums 44 and 46 and the transport belt 18. For this reason, the fuser roll 34 is preferably under driven to cause a slight bubble 54, see FIG. 2, in a gap 49 between the discharge side of the transport belt 18 and the input side of the nip 35 between fuser roll 34 and back-up roll 36. See United States Published Patent Application US 2005/0152710 A1, entitled "Method of Driving a Fuser Roll in an Electrophotographic Printer," filed on Jan. 14, 2004 by Camp et al., the entire disclosure of which is incorporated by reference herein. If the fuser roll 34 is under driven too much, the bubble in the substrate 14 may become too large due to the speed differences between the fuser roll 34 and the transport belt 18, resulting in the substrate 14 contacting physical features within the printer 10 resulting in print defects.

The present invention addresses two scenarios where excessive substrate bubble size may cause print defects. First, if a substrate 14 comprises a multilayer substrate such as an envelope, and the difference between the fuser assembly linear speed and the substrate transport linear speed it too great, then the bubble(s) formed in the envelope may become too large causing a trailing edge of the envelope to "tailflip" and contact structure within the printer 10. Second, if a substrate 14 is long, e.g., has a length greater than the length of an A4 substrate, and the difference between the fuser assembly linear speed and the substrate transport linear speed is too great, then the bubble(s) formed in the substrate 14 may become too large causing the substrate 14 to also contact structure within the printer 10.

Figure 3:
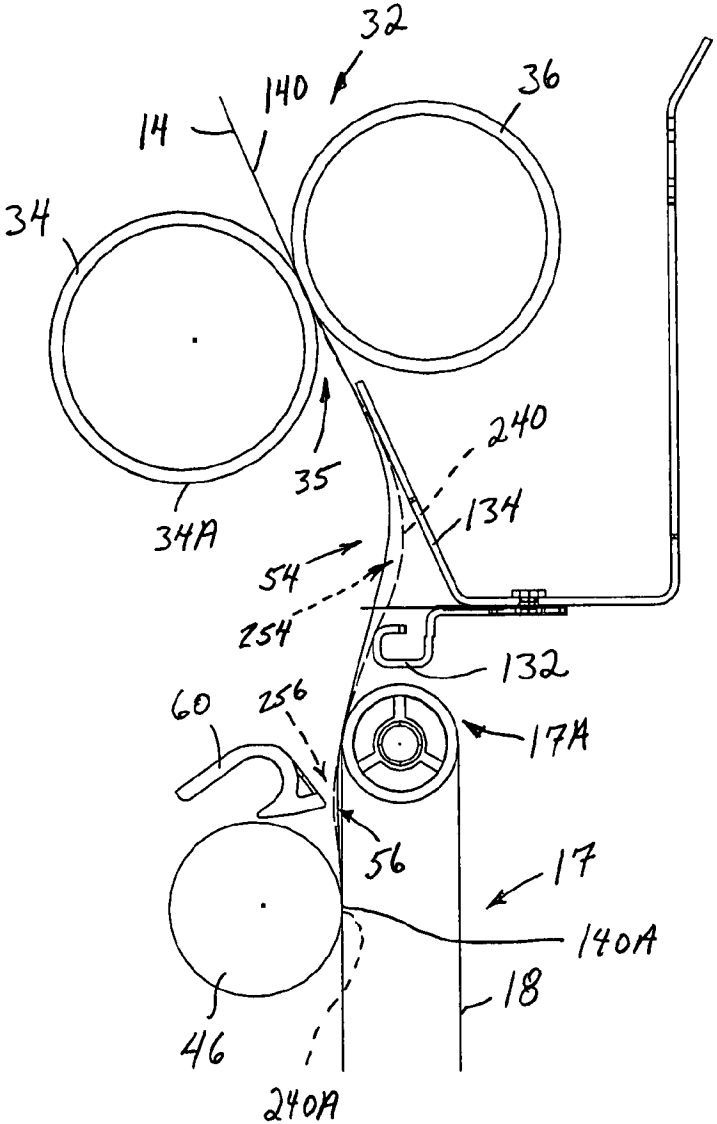
FIG. 3 is a schematic side view of the fuser assembly and a portion of the transport belt of the EP printer shown in FIG. 1, with envelopes shown in solid line and phantom just before trailing edges of the envelopes have exited a nip defined by a PC drum and the transport belt.
Figure 4:
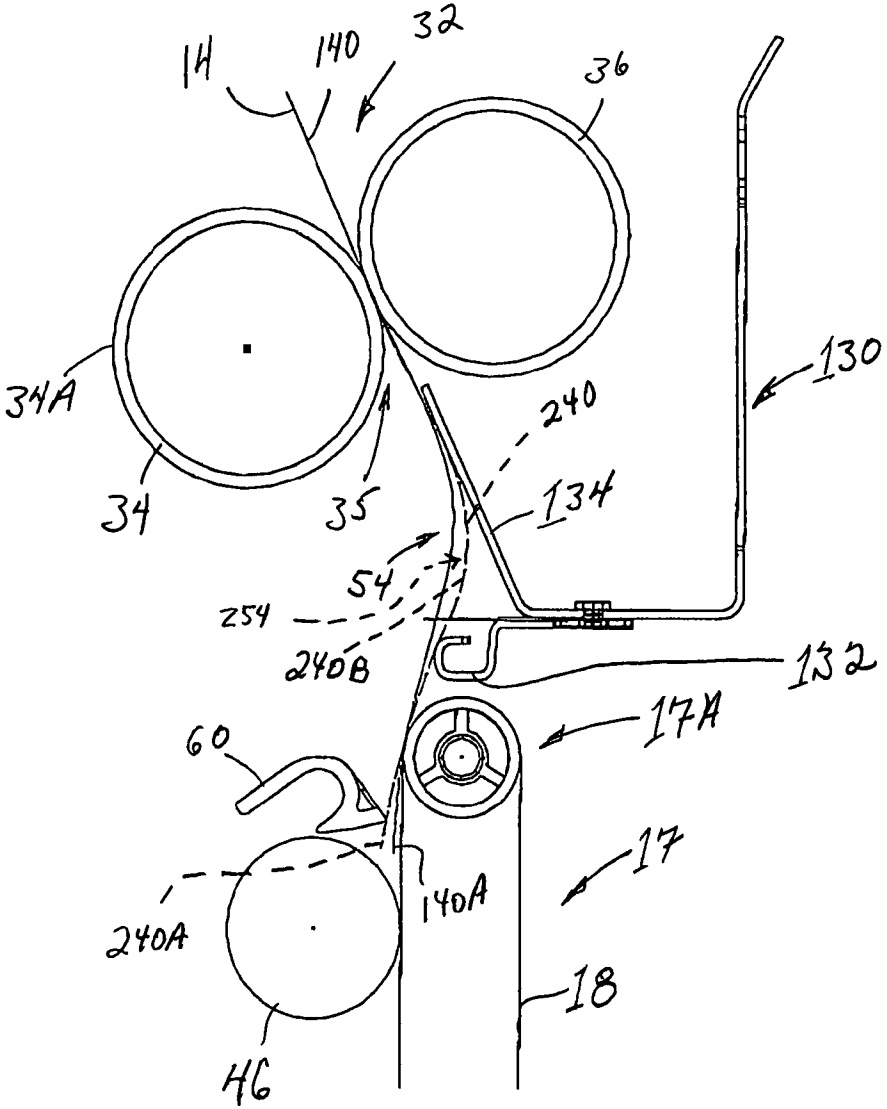
FIG. 4 is a schematic side view of the fuser assembly and a portion of the transport belt of the EP printer shown in FIG. 1, wherein the envelopes in solid line and phantom in FIG. 3 are shown just after their trailing edges have broken free from the transport belt.

Referring now to FIGS. 3 and 4, the printer 10 further comprises a photoconductor housing for supporting the PC drum 46. Only a portion 60 of the PC drum supporting housing is illustrated in FIGS. 3 and 4. The fuser assembly 32 comprises a housing 130 having first and second fuser entry guides 132 and 134. The first entry guide 132 is positioned near an end 17A of the transport assembly 17. The second entry guide 134 functions to guide a substrate 14 into the fuser assembly nip 35.

In FIGS. 2, 3 and 4, the substrate 14 comprises an envelope 140, e.g., a # 10 envelope—4.125 inches×9.5 inches. In FIG. 3, the envelope 140 is shown in solid line just before a trailing edge 140A of the envelope 140 has exited a nip defined by the PC drum 46 and the belt 18. In FIG. 4, the envelope 140 is shown in solid line just after its trailing edge 140A has broken free from the belt 18. The envelope 140 shown in solid line in FIGS. 3 and 4 corresponds to a situation where the difference between the fuser assembly linear speed and the substrate transport linear speed is acceptable, resulting in small first and second bubbles 54 and 56 being formed in the envelope 140. Only the first bubble 54 is shown in FIG. 2 while both the first and second bubbles 54 and 56 are shown in FIG. 3. An envelope 240 is also shown in phantom in FIG. 3 just before its trailing edge 240A has exited from the nip defined between the PC drum 46 and the belt 18. In FIG. 4, the envelope 240 is shown in phantom just after its trailing edge 240A has broken free from the belt 18 so as to no longer be electrostatically tacked to the belt 18. The envelope 240 shown in phantom in FIGS. 3 and 4 corresponds to a situation where the difference between the fuser assembly linear speed and the substrate transport linear speed it too great resulting in large first and second bubbles 254 and 256 being formed in the envelope 240. Because of the large size of the first bubble 254 formed in and the beam strength of the envelope 240, as the trailing edge 240A of the envelope 240 breaks free from the belt 18, it snaps or whips away from the belt 18 resulting in substrate "tailflip," see FIG. 4. This snapping action or tailflip causes an image side 240B of the envelope 240 to contact the photoconductor housing portion 60, see FIG. 4, and/or may disturb the unfused toner image on the envelope 240, resulting in a print defect being formed in the toner image on the envelope 240. In contrast, because the size of the first bubble 54 in the envelope 140 is small, see FIG. 3, little or no substrate tailflip takes place, see FIG. 4. Hence, the envelope 140 does not contact the photoconductor housing portion 60 and, as a result, no print defects occur in the toner image on the envelope 140 resulting from tailflip.

As part of the present invention, it has been found that with multilayer substrates including envelopes, there is less tolerance for large speed mismatches between the fuser assembly 32 and the transport belt 18 as compared with a standard size substrate since a multilayer substrate is more prone to "tailflip." Hence, in accordance with the present invention, the electrical processing circuit 42 controls the drive motors 40 and 41 such that the fuser assembly linear speed is a first fractional amount of the substrate transport linear speed for a normal size substrates, e.g., substrates having a length equal to or less than an A4 substrate, and the fuser assembly linear speed is a second fractional amount of the substrate transport linear speed for multilayer substrates, such as envelopes. The second fractional amount is preferably greater than the first fractional amount so as to reduce the size of any bubbles formed in an envelope. For example, the first fractional amount may be from about 0.988 to about 0.996, while the second fractional amount may be from about 0.996 to about 0.9995. Hence, when the substrate transport linear speed is equal to 106.68 mm/s for normal size substrates, the fuser assembly linear speed may equal 0.992×106.68 mm/s=105.827 mm/s for normal size substrates. When the substrate transport linear speed is equal to 53.34 mm/s for envelopes, the fuser assembly linear speed may equal 0.998× 53.34 mm/s=53.233 mm/s for envelopes.

Figure 5:
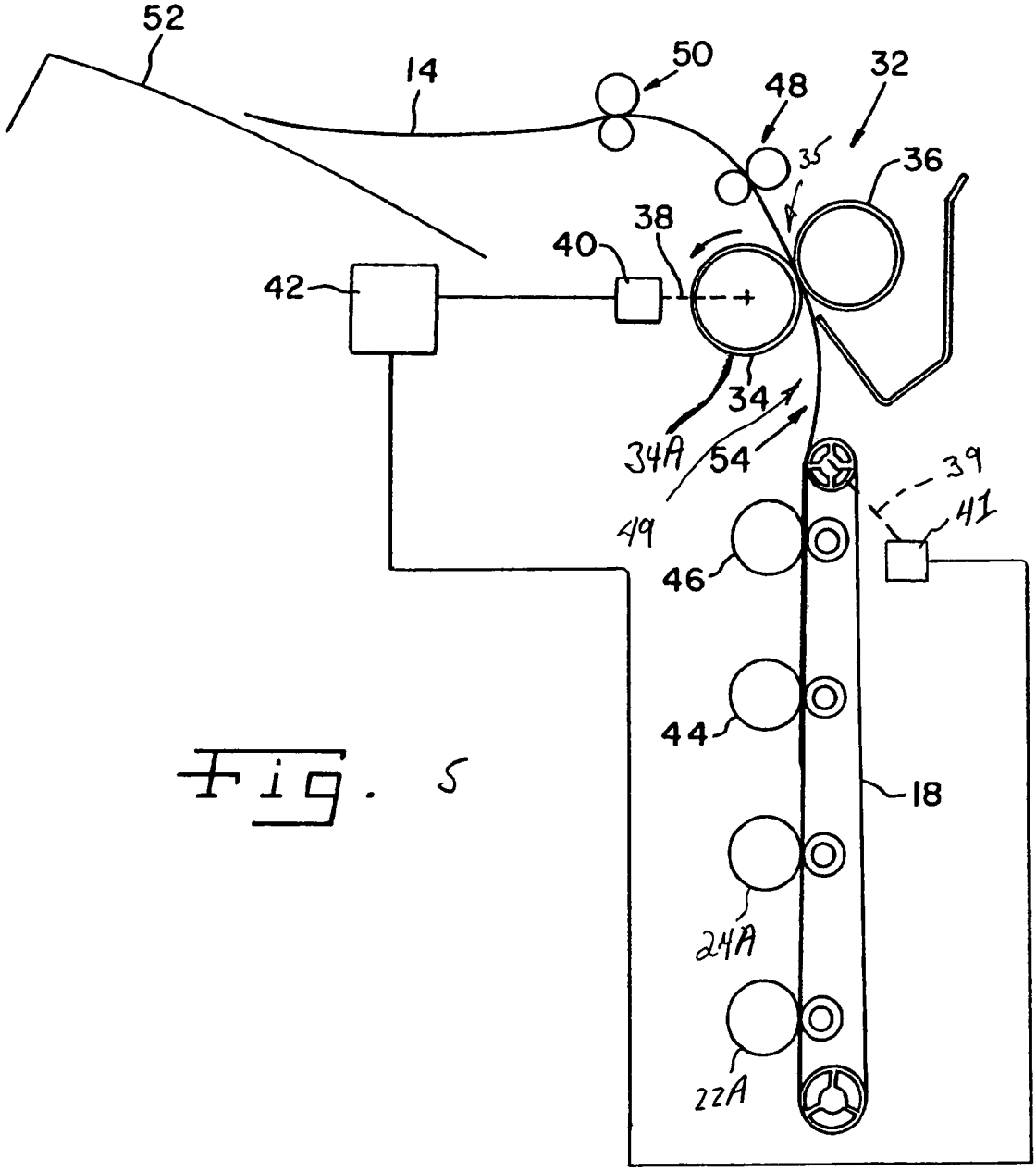
FIG. 5 is a schematic, side view of the paper transport assembly, the fuser assembly, and the electrical circuit of the EP printer shown in FIG. 1; wherein a legal length substrate is shown passing through nips defined by two photoconductor drums and the transport belt and the rolls of the fuser assembly.
Figure 6:
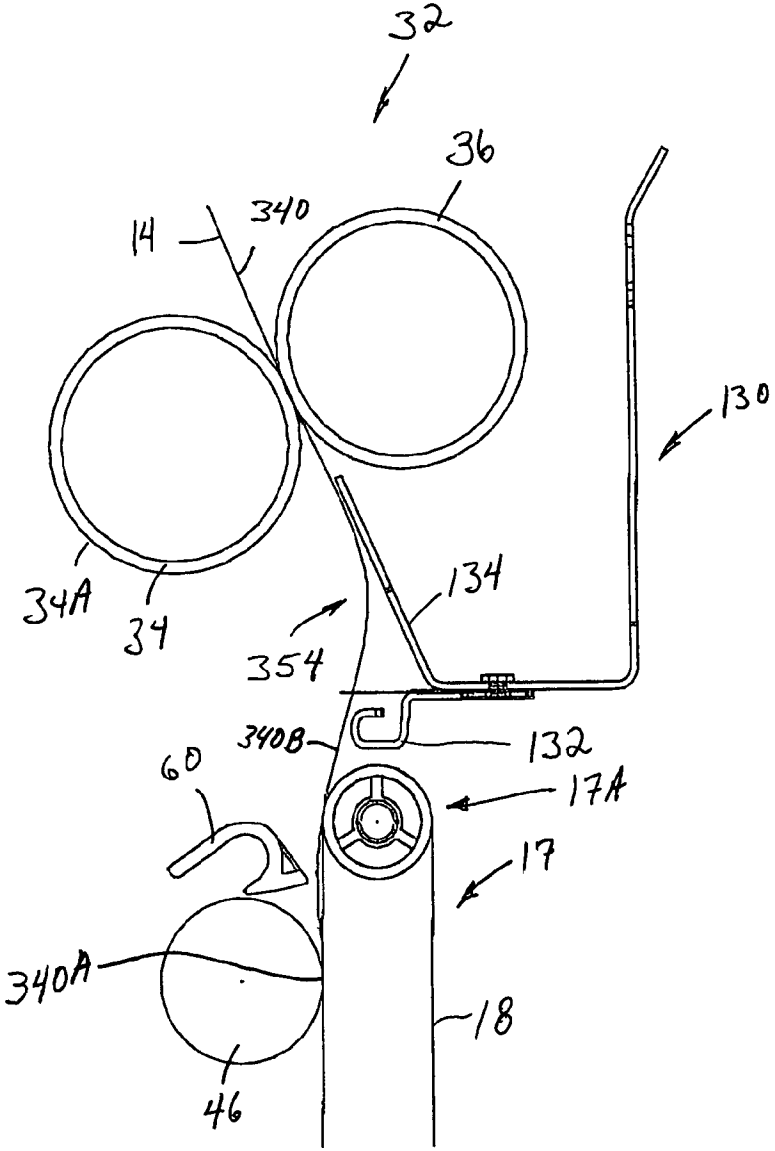
FIG. 6 is a schematic side view of the fuser assembly and a portion of the transport belt of the EP printer shown in FIG. 5, where a trailing edge of a legal length substrate is shown just before it has left a nip defined between the PC drum and the belt and a small bubble is formed in the substrate.
Figure 7:
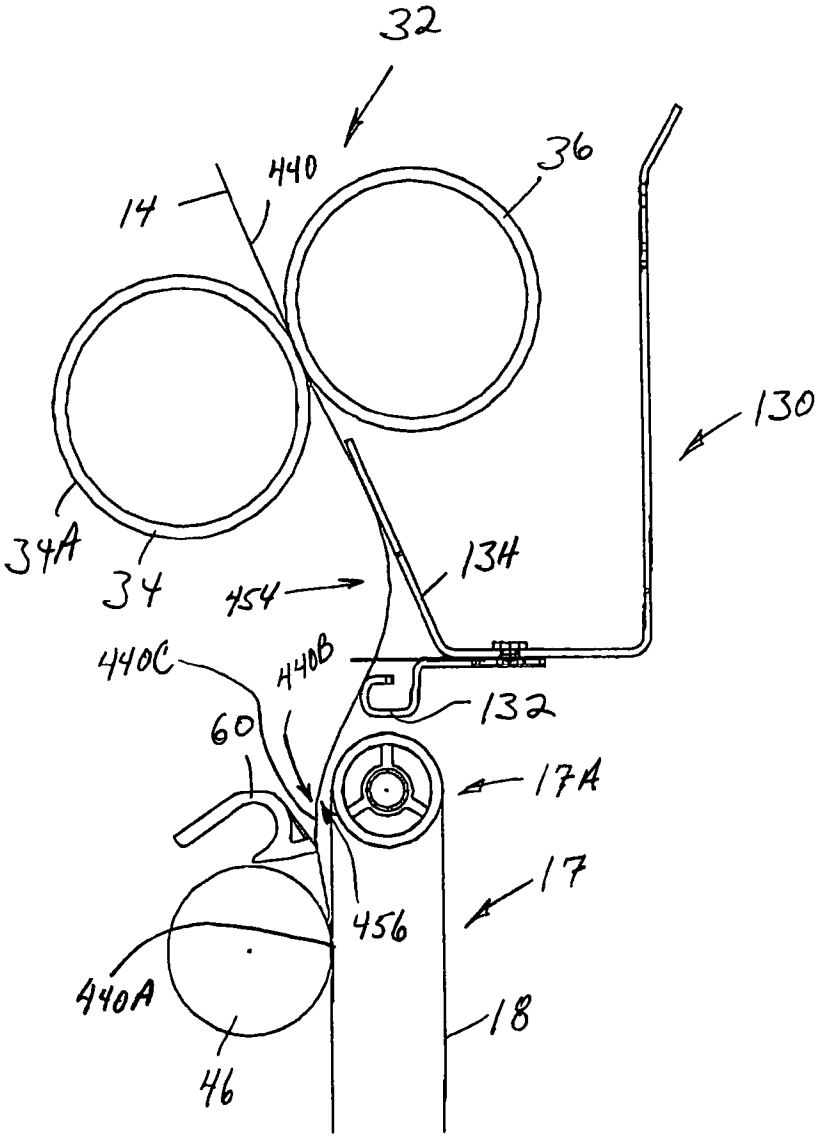
FIG. 7 is a schematic side view of the fuser assembly and a portion of the transport belt of the EP printer shown in FIG. 5, where a trailing edge of a legal length substrate is shown positioned within a nip defined between the PC drum and the belt and large bubbles are formed in the substrate.

In FIGS. 5-7, the substrate 14 moving through the printer 10 comprises a legal length substrate, i.e., a long substrate. A long substrate may have a length greater than the length of an A4 substrate. "Banner media" or "Banner substrates" are considered long media or long substrates. In FIG. 6, a trailing edge 340A of a legal length substrate 340 is shown just before it has left a nip defined between the PC drum 46 and the belt 18. The substrate 340 corresponds to a situation where the difference between the fuser assembly linear speed and the substrate transport linear speed is acceptable, resulting in a small bubble 354 being formed in the substrate 340. In this scenario, an image side 340B of the substrate 340 does not contact the portion 60 of the adjacent photoconductor housing or any other structure within the printer 10. Hence, no print defects in the toner image result due to contact with structure within the printer 10 resulting from large substrate bubbles or tailflip.

In FIG. 7, a legal length substrate 440 is shown with its trailing edge 440A positioned within the nip defined by the PC drum 46 and the belt 18. Further, a section 440B of the substrate 440 near the trailing edge 440A is shown separated from the belt 18 such that it is no longer electrostatically tacked to the belt 18. The substrate 440 in FIG. 7 corresponds to a situation where the difference between the fuser assembly linear speed and the substrate transport linear speed is too great resulting in large first and second bubbles 454 and 456 being formed in the substrate 440. Because of the large size of the second bubble 456, an image side 440C of the substrate section 440B engages with the photoconductor housing portion 60 resulting in toner material on the image side 440C of the section 440B being contacted and smeared by the portion 60.

Accordingly, as part of the present invention, it has also been found that with long substrates, e.g., those having a length greater than an A4 substrate, there is less tolerance for large speed mismatches between the fuser assembly 32 and the transport belt 18. This is because there is no more room within the printer 10, i.e., between the substrate transport assembly 17 and the fuser assembly 32, for receiving substrate bubbles when printing long substrates as compared to short substrates. Hence, in accordance with the present invention, the electrical processing circuit 42 controls the drive motors 40 and 41 such that the fuser assembly linear speed is a first fractional amount of the substrate transport linear speed for at least normal size substrates, substrates having a length equal to or less than the length of an A4 substrate, and the fuser assembly linear speed is a third fractional amount of the substrate transport linear speed for long substrates. The third fractional amount is preferably greater than the first fractional amount so as to reduce the size of any bubbles formed in a long substrate. For example, the first fractional amount may be from about 0.988 to about 0.996, while the third fractional amount may be from about 0.994 to about 0.999. Hence, when the substrate transport linear speed is equal to 106.68 mm/s for normal size substrates, the fuser assembly linear speed may equal 0.992×106.68 mm/s=105.827 mm/s for normal size substrates. When the substrate transport linear speed is equal to 106.68 mm/s for long substrates, the fuser assembly linear speed may equal 0.996×106.68 mm/s=106.253 mm/s for long substrates.

In accordance with the illustrated embodiment, the electrical processing circuit 42 determines when the fuser assembly linear speed is equal to the substrate transport linear speed using the technique disclosed in United States Published Patent Application US 2005/0214010 A1, entitled "Method of Determining a Relative Speed Between Independently Driven Members in an Image Forming Apparatus," filed on Mar. 25, 2004 by Kietzman et al., the entire disclosure of which is incorporated by reference herein. Briefly, this technique involves the following. At the end of manufacturing the printer 10, a calibration operation is effected involving the circuit 42 monitoring a commanded voltage to the fuser motor 40 during the printing of a plurality, e.g., eight, sample substrates. A speed control system defined by the processing circuit 42 and an encoder provided in the drive or fuser motor 40 controls the pulse-width-modulated voltage provided to the fuser motor 40 such that the fuser motor 40 and hence the driven fuser roll 34 operate at a desired constant rotational speed. When the load on the motor 40 increases slightly and its speed drops slightly, the circuit 42 increases the pulse-width-modulated voltage provided to the motor 40 in order to restore the speed of the motor 40, as sensed by the motor encoder, to the desired value. The load on the motor 40 increases when a substrate 14 is positioned within the nip 35 defined by the rolls 34 and 36 in the fuser assembly 32 and at least the nip defined by the PC drum 46 and the transport belt 18, and the fuser assembly linear speed is greater than the substrate transport linear speed causing the substrate transport assembly 17 and at least PC drum 46 to exert a drag force on the substrate.

The first sample substrate is printed with the fuser assembly linear speed clearly less than the substrate transport linear speed. For each subsequent sample substrate, the fuser assembly linear speed is increased slightly while the substrate transport linear speed is maintained constant. During the printing of successive sample substrates 14, each at a slightly different fuser assembly linear speed while the substrate transport linear speed is maintained constant, the pulse-width-modulated voltage provided to the drive motor 40 is monitored to determine when the voltage increases. As noted above, the increase in voltage results due to the load on the motor 40 increasing slightly and its speed dropping slightly. The circuit 42 determines that the fuser assembly linear speed corresponding to the speed at which the fuser assembly 32 is operating just before the voltage is increased to compensate for the increased load on the drive motor 40 substantially equals the substrate transport linear speed. The circuit also determines the speed of the drive motor 40 corresponding to the fuser assembly linear speed which is substantially equal to the substrate transport linear speed.

Once the electrical processing circuit 42 determines the speed of the drive motor 40 corresponding to the fuser assembly linear speed which is substantially equal to the substrate transport linear speed, the circuit 42 multiplies that speed of the drive motor 40 by a selected one of a first, second or third fractional amount, based on the type and/or length of substrate 14 being printed. Example first, second and third fractional values corresponding respectively to normal size, multilayer and long substrates are set out above. The first, second and third fractional amounts do not vary based on the selected substrate transport linear speed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating an electrophotographic printer comprising:

providing an electrophotographic printer comprising a substrate transport assembly including at least one substrate transport member and a fuser assembly including a fuser member;

operating said substrate transport assembly such that said at least one substrate transport member is driven at a substrate transport linear speed; and operating said fuser assembly such that an outer surface of said fuser member moves at a fuser assembly linear speed, wherein said fuser assembly linear speed is a first fractional amount of said substrate transport linear speed for at least normal size substrates such that a bubble in a normal size substrate between said paper transport assembly and said fuser assembly is created, and said fuser assembly linear speed is a second fractional amount of said substrate transport linear speed for envelopes and said second fractional amount is greater than said first fractional amount.

2. The method of claim 1, wherein said first fractional amount is from about 0.988 to about 0.996.

3. The method of claim 1, wherein said second fractional amount is from about 0.996 to about 0.9995.

4. The method of claim 1, wherein said fuser assembly linear speed is a third fractional amount of said substrate transport linear speed for long substrates, wherein said third fractional amount is greater than said first fractional amount.

5. The method of claim 4, wherein said long substrates are substrates longer than an A4 substrate.

6. The method of claim 4, wherein said third fractional amount is from about 0.994 to about 0.999.

7. The method of claim 1, wherein said substrate transport assembly comprises at least one of a belt and a plurality of rolls and said fuser member includes one of a roll and a belt.

8. An electrophotographic printer comprising:

a substrate transport assembly including a first drive motor for driving at least one substrate transport member;

a fuser assembly comprising a second drive motor for driving at least one fuser member; and control structure for controlling the operation of said first and second drive motors such that said first drive motor drives said at least one substrate transport member at a substrate transport linear speed and said second drive motor drives said fuser member such that an outer surface of said fuser member moves at a fuser assembly linear speed, wherein said fuser assembly linear speed is a first fractional amount of said substrate transport linear speed for at least normal size substrates such that a bubble in a normal size substrate between said paper transport assembly and said fuser assembly is created, and said fuser assembly linear speed is a second fractional amount of said substrate transport linear speed for envelopes, wherein said second fractional amount is greater than said first fractional amount.

9. The printer of claim 8, wherein said first fractional amount is from about 0.988 to about 0.996.

10. The printer of claim 8, wherein said second fractional amount is from about 0.996 to about 0.9995.

11. The printer of claim 8, wherein said fuser assembly linear speed is a third fractional amount of said substrate transport linear speed for long substrates, wherein said third fractional amount is greater than said first fractional amount.

12. The printer of claim 11, wherein said long substrates are substrates longer than an A4 substrate.

13. The printer of claim 11, wherein said third fractional amount is from about 0.994 to about 0.999.

14. The printer of claim 8, wherein said substrate transport member comprises at least one of a belt and a plurality of rolls and said fuser member includes one of a roll and a belt.

15. A method of operating an electrophotographic printer comprising:

providing an electrophotographic printer comprising a substrate transport assembly including at least one substrate transport member and a fuser assembly including a fuser member;

operating said substrate transport assembly such that said at least one substrate transport member is driven at a substrate transport linear speed; and operating said fuser assembly such that an outer surface of said fuser member moves at a fuser assembly linear speed, wherein a First ratio of said fuser assembly linear speed to said substrate transport linear speed is equal to a first value less than 1 for at least normal size substrates such that a bubble in a normal size substrate between said paper transport assembly and said fuser assembly is created, and a second ratio of said fuser assembly linear speed to said substrate transport linear speed is equal to a second value less than 1 for multilayer substrates, said second value being greater than said first value.

16. The method of claim 15, wherein said First value is from about 0.988 to about 0.996.

17. The method of claim 15, wherein said second value is from about 0.996 to about 0.9995.

18. The method of claim 15, wherein a third ratio of said fuser assembly linear speed to said substrate transport linear speed is equal to a third value less than 1 for long substrates, wherein said third value is greater than said first value.

19. The method of claim 18, wherein said long substrates are substrates longer than an A4 substrate.

20. The method of claim 18, wherein said third value is from about 0.994 to about 0.999.

21. A method of operating an electrophotographic printer comprising:

providing an electrophotographic printer comprising a substrate transport assembly including at least one substrate transport member and a fuser assembly including a fuser member;

operating said substrate transport assembly such that said at least one substrate transport member is driven at a substrate transport linear speed; and operating said fuser assembly such that an outer surface of said fuser member moves at a fuser assembly linear speed, wherein said fuser assembly linear speed is a first fractional amount of said substrate transport linear speed for at least normal size substrates such that a bubble in a normal size substrate between said paper transport assembly and said fuser assembly is created, and said fuser assembly linear speed is at least one other fractional amount of said substrate transport linear speed for long substrates and for multilayer substrates, said at least one other fractional amount being greater than said first fractional amount.

22. The method of claim 21, wherein said long substrates are substrates longer than an A4 substrate.

23. The method of claim 21, wherein the at least one other fractional amount comprises a second fractional amount for multilayer substrates and a third fractional amount for long substrates, each of the second and third fractional amounts being greater than the first fractional amount.

24. The method of claim 23, wherein the first fractional amount is from about 0.988 to about 0.996 and the third fractional amount is from about 0.994 to about 0.999.

* * * * *

UNITED STATES PATENT AND TRADEMARK OFFICE

CERTIFICATE OF CORRECTION

PATENT NO. : 7,616,911 B2
APPLICATION NO. : 11/390400
DATED : November 10, 2009
INVENTOR(S) : John W. Kietzman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 611 days.

Signed and Sealed this

Nineteenth Day of October, 2010

David J. Kappos

David J. Kappos
*Director of the United States Patent and Trademark Office*